US005156893A

United States Patent [19]

Barthe

[11] Patent Number: 5,156,893

[45] Date of Patent: Oct. 20, 1992

[54] BOW MADE OF GARLAND FOR GIFT BOXES

[76] Inventor: Robert G. Barthe, 43-A Sound View, Madison, Conn. 06443

[21] Appl. No.: 700,395

[22] Filed: May 15, 1991

[51] Int. Cl.[5] ..... A41G 1/00

[52] U.S. Cl. ..... 428/4; 40/124.1; 229/923; 428/10; 428/40; 493/958

[58] Field of Search ..... 428/4, 5, 10, 40; 493/958; 206/806; 229/87.06, 923; 40/124.1

[56] References Cited

U.S. PATENT DOCUMENTS

| | | | |
|---|---|---|---|
| 1,652,855 | 12/1927 | Fernandez | 428/10 |
| 1,773,580 | 8/1930 | Franke | 428/10 X |
| 2,880,540 | 4/1959 | Williams | 428/115 X |
| 3,637,452 | 1/1972 | Sanders | 428/10 |
| 3,832,841 | 9/1974 | Cole | 428/4 X |
| 4,201,806 | 5/1980 | Cole | 428/4 |
| 4,915,996 | 4/1990 | Curry | 428/4 X |
| 4,919,980 | 4/1990 | Pirkey | 428/4 |
| 4,968,540 | 11/1990 | Linsenbigler | 428/5 |
| 5,004,144 | 4/1991 | Selga | 428/4 X |

*Primary Examiner*—Henry F. Epstein
*Attorney, Agent, or Firm*—Richard C. Litman

[57] ABSTRACT

Disclosed is an ornamental bow used as an adornment for gift boxes, hair, apparel, notebooks, tote bags, name tags, and the like, formed of garland having a selected length, width, and diameter. The garland is tightly wrapped in a planar coil, with the ends of the core of the garland being joined beneath said planar coil. The joined ends and the planar coil are secured to a base portion of a display card by glue and/or staples. An upper portion of the display card is connected to the base portion by tear perforations and includes an opening for hanging the display card on a rack, and printed information. The rear surface of at least the base portion includes a pressure-sensitive adhesive and a peel-away cover protecting said adhesive, whereby the base portion, when detached from the upper portion, may be mounted on a receiving surface along with the garland bow. The strips forming the garland may have a variety of colors, and are made of a material having an elastic memory, whereby the bow is crush-resistant.

8 Claims, 1 Drawing Sheet

BOW MADE OF GARLAND FOR GIFT BOXES

BACKGROUND OF THE INVENTION

1. Field of the Invention

This invention relates to a decorative ornament and, more particularly, to a decorative bow formed of garland which may be attached to gift boxes.

This invention further relates to the method of making a decorative bow made of garland which may be attached to gift boxes from resilient material whereby the bow is crush-resistant, thereby forming a decorative ornament for the gift box.

2. Description of the Related Prior Art

Strings of garland have been made in the past by a variety of methods. In U.S. Pat. No. 1,652,855 issued Dec. 13, 1927 to John C. Fernandez, a string, strip or length of any desired material is drawn or passed through or dipped into an adhesive solution of any suitable character, such as glue, after which the string with its wet coat of adhesive solution is drawn through a cyclone chamber containing a shower of flying driven multicolored particles such as confetti, some of which contact with and adhere to the moving string in irregular disordered positions, with the varied colors contrasting in pleasing effect, after which the garland thus formed is drawn into and through a drying chamber to set the adhesive. Varicolored metal powders or shavings, textile threads, beads, mineral particles, and pearls, etc. may be used.

U.S. Pat. No. 1,773,580 issued Aug. 19, 1930 to B. E. Franke discloses "tinsel" garland formed of a cotton core or cord composed of several strands with which transverse strips of tinsel are interwoven. Diametrical strips of tinsel are interwoven at their centers with the strands of the core or cord so that the end portions of the strips on each side of the center project on all sides of the core in substantially radial directions, giving the effect of a tinsel brush or garland of indefinite length. As disclosed by Franke, the garland is about 1 inch in diameter. Franke increases the luminosity of the garland by wrapping the core or cord with tinsel, which also helps to hide the core or cord from view.

U.S. Pat. No. 2,880,540 issued Apr. 7, 1959 to Lewis C. Williams discloses a garland construction which uses a metallic foil such as aluminum foil, which may be coated with a flexible transparent or colored plastic coating to minimize oxidation. The flexible coating makes the foil stronger.

U.S. Pat. No. 3,637,452 issued Jan. 25, 1972 to Frederic M. Sanders discloses garland formed by wrapping cut synthetic polymer sheeting about wire cores or frames. The polymer is rigidified by introducing a permanent crease in the cut strips. The polymer sheeting used normally has a uniform thickness in the range of 3 to 10 mils and is about 4 to 12 inches wide. The sheeting may be made from any extrudable or calendered synthetic polymer, including the available polyvinyl halides, polyesters, polyamides and polyolefins.

The above-identified patents do not teach the use of garland in the formation of a decorative ornament or bow for a gift box.

Similarly, U.S. Pat. No. 4,919,980 issued Apr. 24, 1990 to Aria Pirkey does not teach the use of garland in the formation of a decorative ornament or bow. Pirkey forms a decorative bow by twisting and coiling a loop of sheet material, stapling the coiled loop of sheet material at its center to a backing sheet which may have an adhesive side for attaching the completed bow to another surface, and cutting the ends of the loops, thereby forming a number of radially extending leaves in a hemispherical shape which is crush-resistant. The shape of the leaves helps the bow to resist crushing. The use of a resilient sheet material enables the bow to return to its original shape if crushed.

SUMMARY AND OBJECTS OF THE INVENTION

It is an object of this invention to provide an ornamental decoration for a gift box.

More particularly, it is an object of this invention to provide an ornamental decoration in the form of a bow made from a length of garland for a gift box.

It is a further object of this invention to provide a method of forming a bow made of a length of garland for a gift box.

These and other objects are achieved by tightly winding a length of garland in circular fashion into a planar coil with both ends joined at the middle bottom. The number of circular wraps varies with the length of garland being wound. It is currently contemplated that lengths of from 6 inches to 36 inches will be used depending on the size of the bow, with the garland having a diameter of 3 inches. A 6-inch length of garland 3 inches in diameter is referred to in the industry as 6"×3-ply garland. It is contemplated that 2", 3", 4", 5"×2, 3, 4, 6, 9, 12-ply can be used. It is unlikely that a length larger than 36 inches would be used except for trade show or large-account display. The width of the individual garland strips or flags can vary widely, from nearly as thin as a heavy thread, e.g. 1/128 inch to 1/16 inch, to approximately ½ inch wide and even larger should a display warrant it. Some bows can incorporate both narrow and wide flags in the same bow, if desired.

The ends of the garland are joined in any suitable manner such as by twisting the core or cord ends together or they may simply be folded under the coiled core. By tightly winding the garland the ends and a generous portion of the core or cord may be secured to a display card with glue and/or staples. The upper portion of the display card may be die-cut for hanging on a rack. The front of the upper portion of the display card can be printed with the company logo and product information, while the back of the upper portion of the display card can be printed with UPC code and company information. The base of the display card is separable from the upper portion of the display card by means of perforations. The bow made of garland is attached to the front surface of the base, while the back of at least the base has a pressure-sensitive adhesive covered by a peel-off sheet.

While disclosed as an ornamental bow made of garland to be attached to a gift box, other uses are contemplated, including as a hair adornment item such as a barrette or headband, as well as an apparel adornment, a name tag, and a novelty adornment for a notebook or tote-bag.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

Figure 1:
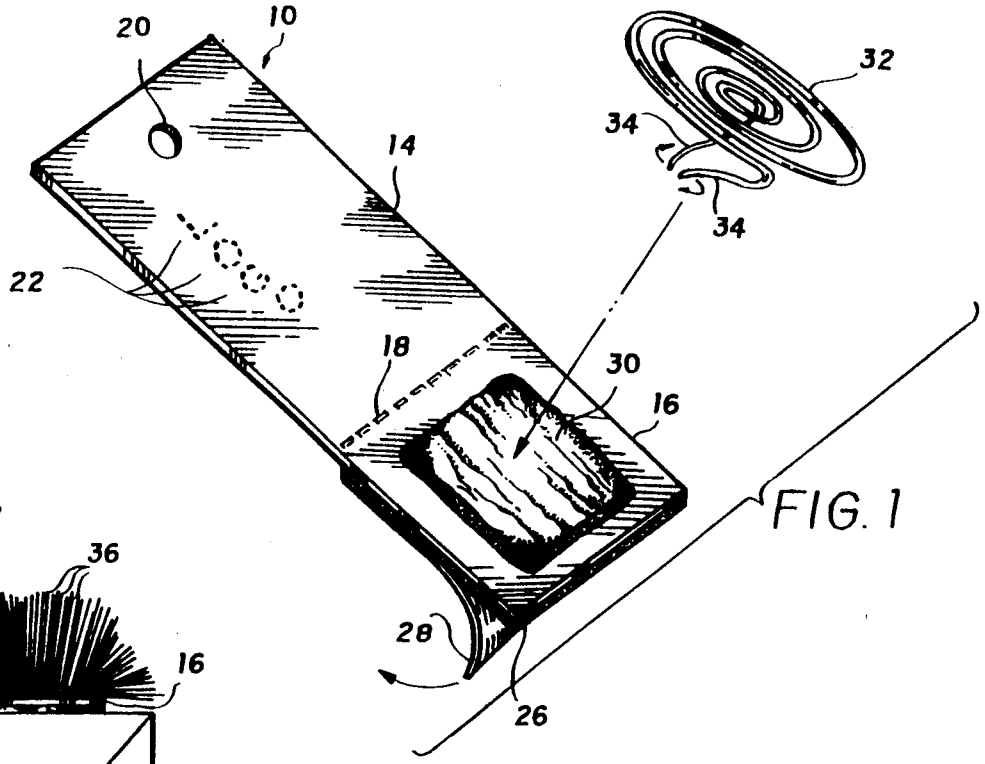
FIG. 1 is an exploded perspective view showing the display card and the garland core or cord without the strips of tinsel and the like omitted, so as to better show the coiling of the core or cord and the method of joining the ends thereof prior to mounting on the display card.
Figure 2:
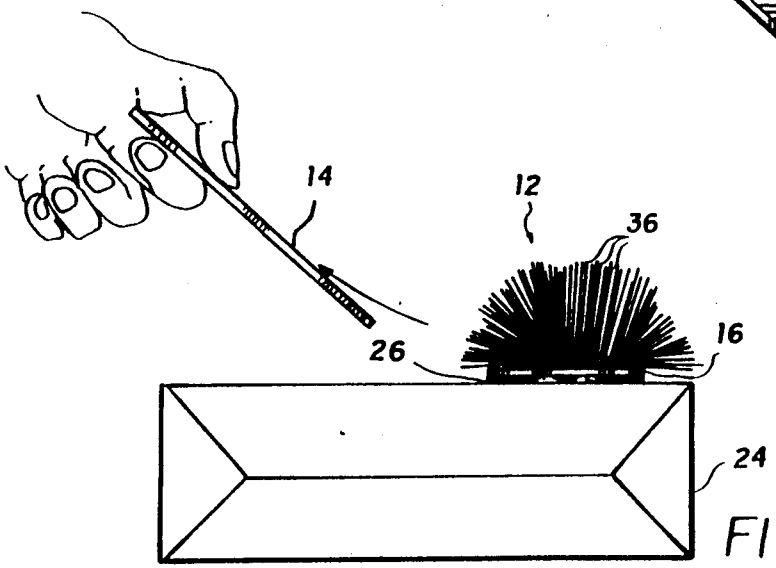
FIG. 2 is a side view of the bow made of garland mounted on a gift box.
Figure 3:
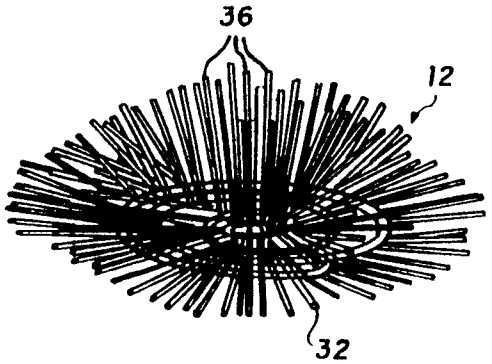
FIG. 3 is a perspective view of the garland formed as an ornamental bow prior to mounting thereof on a display card.

Turning to FIG. 1, there is shown a representative display card 10 for mounting a bow made of garland 12, shown more clearly in FIGS. 2 and 3. Display card 10 is formed of an upper portion 14 and a base portion 16 separable from upper portion 14 by means of a line of tear perforations 18. Upper portion 14 of display card 10 includes an opening 20 of any suitable configuration for the purpose of hanging the display card on a rack. On the front face of upper portion 14, logo 22 and other product information may be printed. Such information may include suggested uses of the bow made of garland, including hair, apparel, notebook or tote-bag adornment, as well as a name tag or an adornment for a gift box, such as gift box 24 shown in FIG. 2. The rear surface of upper portion 14 of display card 10 may be printed with UPC code, company information and the like.

Pressure-sensitive adhesive 26 is provided on the rear surface of at least base portion 16, adhesive 26 being covered by a peel-away cover 28. A bow made of garland 12 is secured to the front surface of base portion 16 by means of glue 30 and/or staples (not shown).

The bow made of garland 12 is formed by tightly coiling a suitable length of conventional garland. In FIG. 1, the strips of tinsel, metallic foil or the like 36, have been omitted in order to clearly show the coiling of core or cord 32 and the joining of the core ends 34 for example by twisting together beneath the core or cord 32 prior to securing a bow made of garland 12 to base portion 16. While manual twisting of the ends is shown in FIG. 1, it is contemplated that during manufacture the ends will be secured in any suitable fashion to prevent the material from unraveling and fraying. By tightly winding the core 32 into a planar coil, a generous portion of the core and the ends 34 may be secured to base portion 16 by glue 30 and/or staples. The strips of tinsel, metallic foil or the like, which may be provided in a variety of colors, form an attractive, brush-like bow which, because of elastic memory, is crush-resistant.

In use, when a the bow made of garland 12 is to be applied to a surface such as on gift box 24, upper portion 14 of display card 10 is separated from base portion 16 at tear perforations 18, and peel-away cover 28 is removed. Thereafter, base portion 16 is secured to the surface of box 24 by pressure-sensitive adhesive 26. If desired pressure-sensitive adhesive 26 and peel-away cover 28 may be extended to the rear surface of upper portion 14 of display card 10.

The size of the bow made of garland 12 produced depends largely on the length and diameter of garland used. Typically a length of 6 inches to 18 inches of garland 3 inches in diameter is used, although other lengths and widths may also be used without departing from the scope of the invention.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A bow made of garland and card assembly comprising:

a display card means including an upper portion and a base portion;

said upper portion including an opening therethrough enabling said display card means to be hung on a rack;

said base portion having said bow made of garland secured thereto;

said base portion being separable from said upper portion along a line of tear perforations;

said base portion including a pressure-sensitive adhesive and a peel-away cover on a rear surface thereof, whereby said base portion may be attached to a receiving surface;

said bow made of garland being secured to a front surface of said base portion by fastening means on said front surface of said base portion;

said bow made of garland including a selected length of a core in the form of a cord, said core having strips of tinsel thereon to form a length of garland;

said length of garland being tightly coiled, with ends of said core cord being joined below said tightly-coiled length of garland;

said core cord ends and a substantial portion of said core being secured to said front surface of said base portion by said fastening means.

2. A bow made of garland and card assembly as in claim 1, wherein:

said fastening means is glue.

3. A bow made of garland and card assembly as in claim 2, wherein:

said strips of tinsel are formed of a material having an elastic memory, whereby said bow made of garland is crush-resistant.

4. A bow made of garland and card assembly as in claim 1, wherein:

said fastening means is staples.

5. A bow made of garland and card assembly as in claim 4, wherein:

said strips of tinsel are formed of a material having an elastic memory, whereby said bow made of garland is crush-resistant.

6. A bow made of garland and card assembly as in claim 1, wherein:

said fastening means is glue and staples.

7. A bow made of garland and card assembly as in claim 6, wherein:

said strips of tinsel are formed of a material having an elastic memory, whereby said bow made of garland is crush-resistant.

8. A bow made of garland and card assembly as in claim 1, wherein:

said strips of tinsel are formed of a material having an elastic memory, whereby said bow made of garland is crush-resistant.

* * * * *